US005850796A

United States Patent [19]

Cislo

[11] Patent Number: 5,850,796

[45] **Date of Patent: *Dec. 22, 1998**

[54] CASE OR LOCKBOX RESISTANT TO FORCED ENTRY AND THEFT AND METHOD FOR CONVERTING CASE TO SECURE AND MOUNTABLE LOCKING CONTAINER

[76] Inventor: Daniel M. Cislo, 3413 Rambla Pacifico, Malibu, Calif. 90265

[ * ] Notice: This patent issued on a continued prosecution application filed under 37 CFR 1.53(d), and is subject to the twenty year patent term provisions of 35 U.S.C. 154(a)(2).

[21] Appl. No.: 755,549

[22] Filed: Nov. 22, 1996

[51] Int. Cl.[6] ..... E05G 1/04

[52] U.S. Cl. ..... 109/51; 70/63; 70/71; 70/161; 70/418; 206/1.5; 206/317; 292/346

[58] Field of Search ..... 70/63, 418, 1.5, 70/DIG. 63, 158–162, 166–169, 69–74, 416, 417; 109/51, 74; 292/346; 206/1.5, 317

[56] References Cited

U.S. PATENT DOCUMENTS

| | | | |
|---|---|---|---|
| 72,283 | 12/1867 | Gardner | 109/51 |
| D. 339,684 | 9/1993 | Cislo | D3/73 |
| D. 349,231 | 8/1994 | Cislo | D8/349 |
| 963,883 | 7/1910 | Farley | 109/51 |
| 1,805,759 | 5/1931 | Chamberlain | 109/51 |
| 1,916,509 | 7/1933 | Hammer | 109/51 X |
| 2,512,028 | 6/1950 | MacMillan | 70/63 X |
| 3,236,075 | 2/1966 | Williams | 70/63 |
| 3,347,069 | 10/1967 | Hollingshead, Jr. | 70/63 |
| 3,742,741 | 7/1973 | Cahan | 70/63 |
| 3,934,910 | 1/1976 | Radke | 292/346 |
| 3,963,269 | 6/1976 | Rosenberg | 292/346 |
| 4,171,837 | 10/1979 | McRoy | 70/418 X |
| 4,249,684 | 2/1981 | Miller et al. | 109/51 X |
| 4,325,531 | 4/1982 | Omholt | 70/63 X |
| 4,345,787 | 8/1982 | Dabrowski | 292/346 |
| 4,637,326 | 1/1987 | Baitz et al. | 109/51 X |
| 4,717,185 | 1/1988 | Hartley | 292/346 X |
| 4,788,838 | 12/1988 | Cislo | 70/63 |
| 4,890,466 | 1/1990 | Cislo | 70/63 |
| 5,009,088 | 4/1991 | Cislo | 70/63 |

FOREIGN PATENT DOCUMENTS

| | | | |
|---|---|---|---|
| 0203837 | 12/1986 | European Pat. Off. | 70/418 |
| 862743 | 1/1953 | Germany | 70/63 |
| 1124602 | 3/1962 | Germany | 70/63 |
| 1292033 | 4/1969 | Germany | 70/63 |
| 866248 | 4/1961 | United Kingdom | 70/63 |
| 2037257 | 7/1980 | United Kingdom | 70/63 |

*Primary Examiner*—Lloyd A. Gall
*Attorney, Agent, or Firm*—Cislo & Thomas LLP

[57] ABSTRACT

A gun lockbox resistant to forced entry includes a guard member formed to an inside edge of a housing half, and one or more locks in an opposing housing half which engage the guard member, for securing the housing halves together and preventing insertion of a prying tool therebetween. The gun lockbox may additionally include clip members to attach the lockbox to a stationary object within a transport vehicle or to a wall, the clip members preferably consisting of complementary brackets with the attachment hardware being located inside the lockbox, to prevent easy theft of the lockbox outright. The gun lockbox or case may further be configured to facilitate aligning and positioning to the stationary object, through raised portions on the exterior surface of one of the housings. Also, the gun lockbox may be constructed from a conventional case.

3 Claims, 3 Drawing Sheets

CASE OR LOCKBOX RESISTANT TO FORCED ENTRY AND THEFT AND METHOD FOR CONVERTING CASE TO SECURE AND MOUNTABLE LOCKING CONTAINER

FIELD OF THE INVENTION

The present invention relates generally to safety and anti-theft devices for guns or objects such as video cameras, power tools, or the like, and to a method for securely storing such valuables as well as preventing the locking container itself from being taken away without authorization.

BACKGROUND OF THE INVENTION

Locking cases or strongboxes for small handguns, rifles, shotguns, assault weapons, and other valuables are known in the prior art. In particular, military personnel, peace officers, forest rangers, and game hunters are among those with a need to safely store and transport larger guns. In the event it is necessary for such individuals to leave a police car or other transport vehicle unattended, there is the concern that the weapon may be taken from the lockbox or the entire lockbox carried away from the vehicle. Such an event may present a serious security risk to the individual deprived of the gun, as well as representing a loss of expensive property that must be replaced.

While lockboxes for guns and other valuables currently being sold have proven generally suitable for their intended purposes, they possess inherent deficiencies which detract from their overall effectiveness. The elongate lockboxes used to store and transport rifles and shotguns generally include a number of latches and associated locks, spaced apart along the edges of case halves where they come together. Modern-day lockboxes are commonly mass produced of Kevlar®-reinforced plastic or other composite materials which are strong and lightweight, but not as stiff as steel. Consequently, the lockbox is prone to being broken into by wedging a crowbar or other prying tool between the two halves of the case, to pry the case apart. Then by flexing or twisting the two halves relative to each other, the locks are disengaged and access gained to the contents.

The contemporary composite lockboxes issued and in the field, and their means of manufacture (i.e. tooling), represent a substantial investment in a less than optimal design. To manufacture a new lockbox incorporating one or more improvements, however, could prove prohibitively expensive if the entire case must be replaced and/or new composite tooling fabricated. Accordingly, limited demand for additional lockboxes and the high cost of new tooling have discouraged others from developing and producing an improved product.

There is a second problem having to do with outright theft of lockboxes from the transport vehicles, although apparently fixedly attached to transport vehicles. This can occur if the attaching hardware is accessible, whereby through use of ordinary hand tools the lockbox can be separated from the attach surface. Thereafter, the thief may simply walk away with the lockbox, including the contents.

Additionally, in the past it was difficult to fixedly attach a lockbox to a transport vehicle, as the prior-art attaching hardware made for a difficult installation. An individual was typically required to rely on a narrow line of sight to the attaching hardware, and under such difficult conditions make repeated small movements of the lockbox to align it for installation. This proved to be a tedious and time-consuming process.

In view of the shortcomings of the prior art, it is desirable to provide a secure lockbox and carrying case for guns or other valuables that is not susceptible to forced entry to get at the rifle, shotgun, video camera, power tool or the like inside. It is desirable to provide a secure case that may be attached to a stationary object from inside the case, and once the secure case is securely locked it is difficult to forcibly remove from the stationary object as there is no access to the attaching hardware. Further, it is desirable that the secure case and/or attaching hardware provide for easy positioning and alignment to the stationary object, for attachment thereto. Still further, it is desirable that the secure case may be reconstructed from a conventional lockbox, so as to minimize the cost of realizing the above desires.

SUMMARY OF THE INVENTION

The present invention specifically addresses and alleviates the above-mentioned deficiencies associated with the prior art. More particularly, the present invention comprises a securable case and lockbox resistant to forced entry and theft, including a pair of housings coupled together which hold the gun, and one or more locks along adjacent sides of the housings where the housings come together to secure the lockbox closed. Importantly, further included is a guard member along an inside edge of one of the adjacent sides and extending toward the other housing, to prevent a tool from being inserted into the lockbox to pry it open. The guard member preferably has a ledge by which the locks directly engage the guard member. This secures the lockbox and prevents the adjacent sides of the lockbox from being moved apart from each other. The guard member is preferably an elongate channel of sufficient stiffness to prevent it from being forced out of the way by a crowbar or other prying tool. The elongate channel may be of an L-shaped cross section having an upstanding leg and a cap, or other suitable configuration.

Also in the preferred embodiment, the gun lockbox includes clip members to hold one of the housing halves to a stationary object, such as a wall or a flat surface within a transport vehicle. More particularly, the gun lockbox comes with a bracket attachable to the stationary object, and a second bracket attachable to an interior surface of the lockbox. The lockbox is positioned to the stationary object such that the brackets are aligned, and the brackets are fastened together from inside the lockbox. Upon closing and locking the lockbox, the lockbox is attached close to the stationary wall with the fasteners securely locked inside the lockbox, making it difficult to remove the closed lockbox from the stationary object.

Additionally, the clip members and gun lockbox of the preferred embodiment are configured such that positioning of the lockbox to the stationary object and alignment of the respective brackets is not a difficult task, despite the narrow line of sight. The bracket attached to the stationary object protrudes therefrom and is of a specific size. The lockbox is configured with corresponding, spaced-apart protruding ribs, to facilitate the locating of the lockbox to the stationary object.

The present invention also lends itself to retrofitting a conventional gun case. To resist forced entry into the lockbox, the guard member is installed to an inside edge of one of the housing halves. One or more of the locks are installed to the opposing housing half, so as to engage the guard member. To resist theft of the lockbox itself, corresponding brackets are attached to a stationary object and one of the housings. Then, the lockbox is positioned so as to substantially align the brackets, and, fasteners are installed from inside the open lockbox to complete the installation.

These, as well as other, advantages of the present invention will become more apparent from the following description and drawings. It is understood that changes in the specific structure shown and described may be made within the scope of the claims without departing from the spirit of the invention.

DETAILED DESCRIPTION OF THE INVENTION

The detailed description set forth below in connection with the appended drawings is intended as a description of the presently preferred embodiment of the invention, and is not intended to represent the only form in which the present invention may be constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

Figure 1:
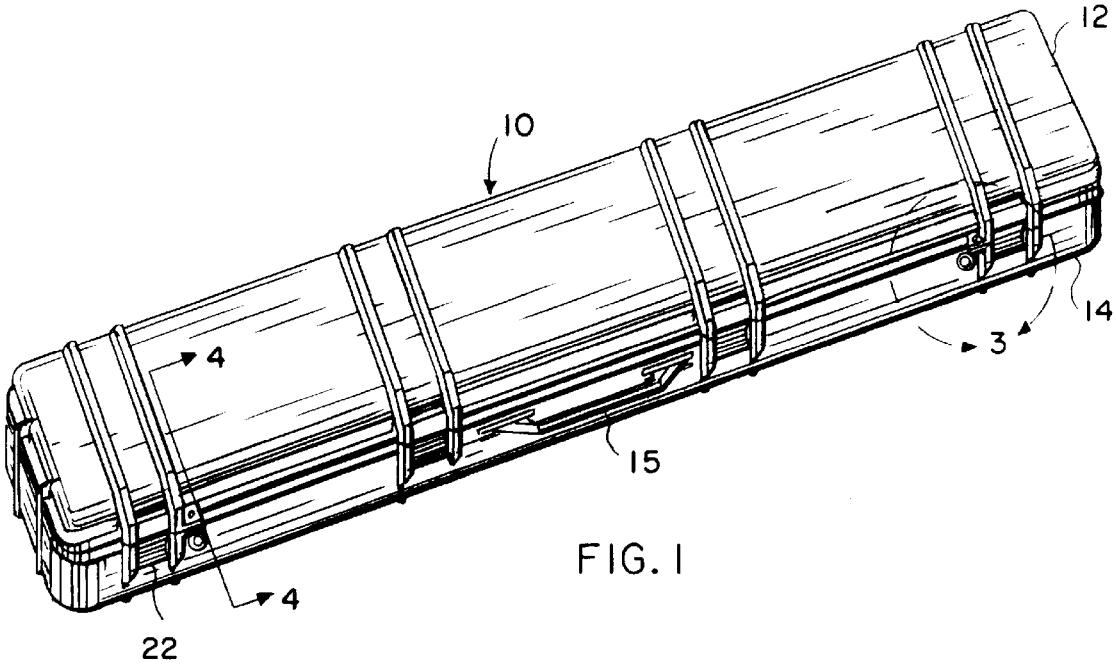
FIG. 1 is a top perspective view illustrating an exemplary gun lockbox resistant to forced entry and theft in accordance with the present invention, the gun lockbox shown in a closed position.
Figure 2:
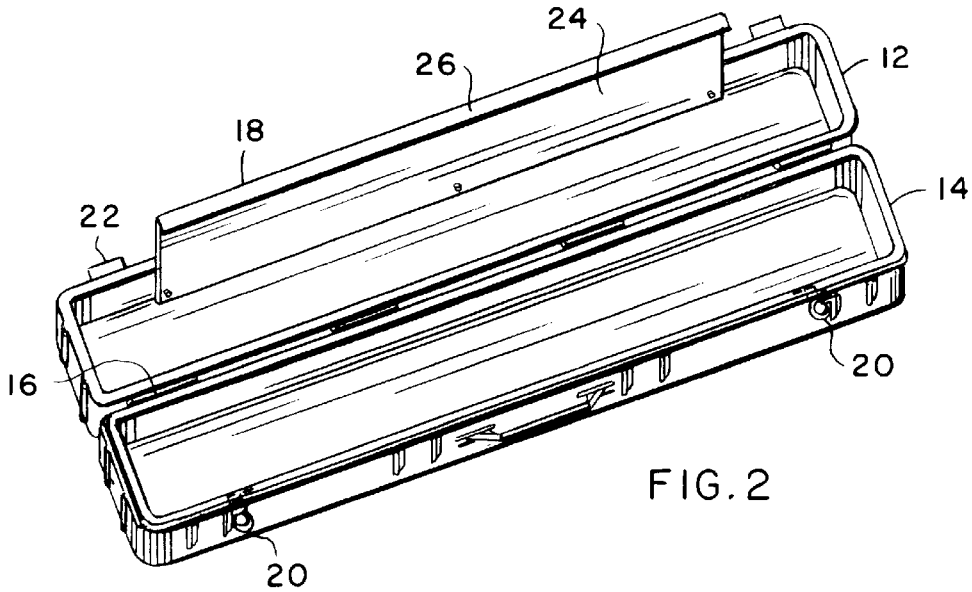
FIG. 2 is a top perspective view illustrating the gun lockbox, shown in an open position.

A gun lockbox resistant to forced entry and theft of the present invention is illustrated in FIGS. 1–6 which depict a presently preferred embodiment of the invention. Referring first to FIGS. 1 and 2, the gun case or lockbox 10 is comprised generally of an upper housing 12 and lower housing 14 attached together by four sets of reinforced hinges 16. The upper and lower housings 12 and 14 may brought together and secured to form a chamber, or interior space, having an approximate volume of 50 inches×12 inches×6 inches. However, various-sized cases with varying inner and outer dimensions may be used. Also typically included inside the lockbox 10 are large foam pads or other conventional means (not shown), to restrain and prevent movement of the weapon inside the chamber. The gun lockbox 10 may additionally include a conventional handle 15 for easy carrying.

To resist unauthorized entry into the lockbox 10, lock means 20 are provided to secure together adjacent sides of the housings 12 and 14. Importantly, also provided is a guard member 18 attached to an inside edge of the upper housing 12 and extending toward the corresponding edge of the lower housing 14, to prevent a crowbar or other prying tool from being inserted into the chamber between the housings 12 and 14 (see FIG. 4). Latch means 22 may be provided to releasably fasten together the housings 12 and 14, appropriate when the gun lockbox 10 is supervised by a custodian or access is only available to authorized users.

Figure 3:
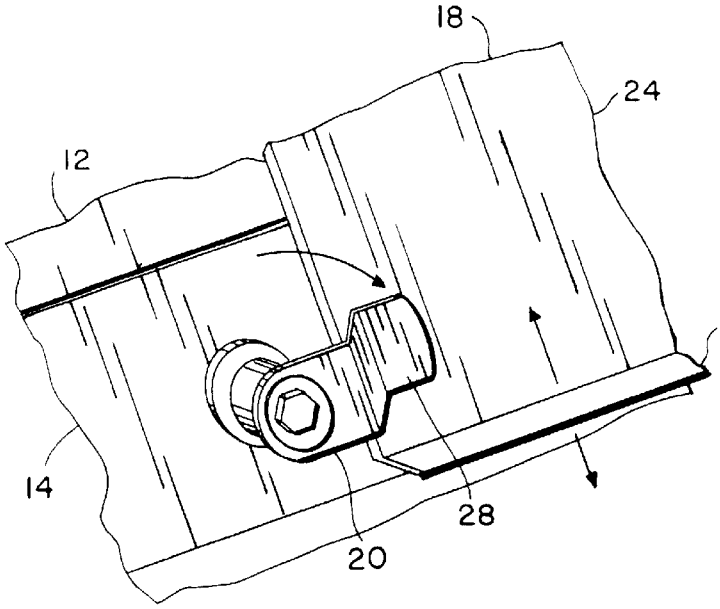
FIG. 3 is an enlarged partial view looking from inside the closed gun lockbox, showing a lock means engaging a guard member.
Figure 4:
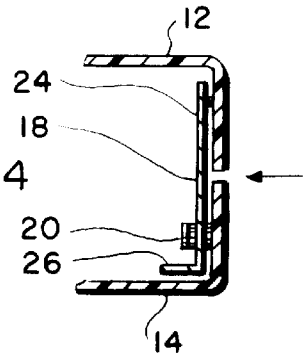
FIG. 4 is a cross section view showing the guard member along inside edges of adjacent sides of the gun lockbox shown in FIG. 1 along lines 4—4.

Now referring to FIGS. 3 and 4, the gun lockbox 10 of the preferred embodiment may be further described. The guard member 18 is preferably an elongate channel or L-shaped element having a generally L-shaped cross section. The guard member 18 may be slightly bent inwardly along its length or width, to properly allow for the lockbox's 10 closure. An upstanding leg 24 extends along an inside edge of the upper housing 12 toward the corresponding inside edge of the lower housing 14, and transitions to a cap or ledge 26 extending into the chamber or interior of the gun lockbox 10. The lock means 20 is preferably a conventional, key-operated lock having a twist arm 28. The twist arm 28 upon being turned to engage the guard member 18 is operative to prevent the upper and lower housings 12 and 14 (see FIG. 3) from being spread apart. The housings 12 and 14 are typically fabricated of a composite material, reinforced Kevlar® or fiberglass, that is relatively strong and lightweight, but not as stiff as most metals. Nevertheless, with the guard member 18 engaged by the lock means 20, the housings 12 and 14 are not susceptible to being pried apart to gain access to the lockbox 10.

Figure 5:
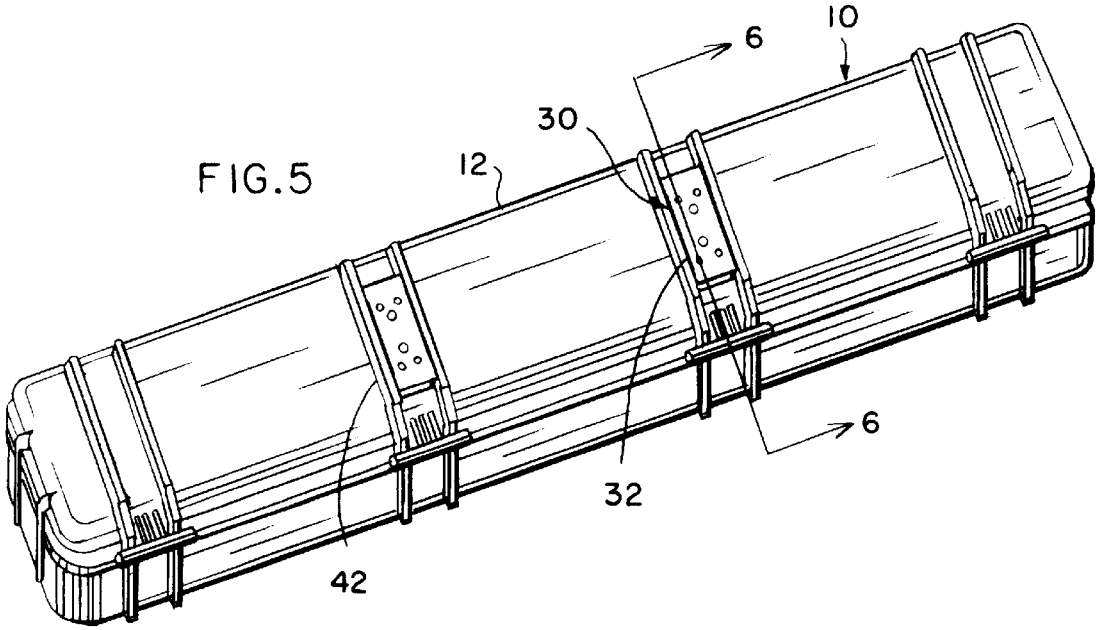
FIG. 5 is a top perspective view showing alignment means for positioning the gun lockbox for installation to a stationary object.
Figure 6:
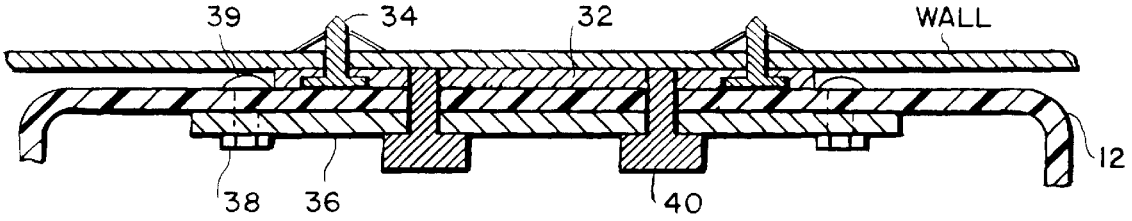
FIG. 6 is a cross section view showing clip members for attaching the gun lockbox to the stationary object taken along lines 6—6 shown in FIG. 5.
Figure 7:
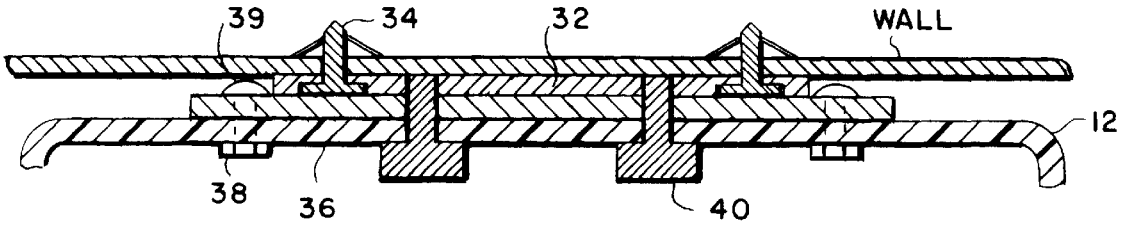
FIG. 7 is a cross section view showing an alternate embodiment of attaching the clip members along the same line as 6—6 of FIG. 5.

Referring to FIGS. 5 and 6, clip members 30 to secure the gun lockbox 10 to a stationary object, such as a wall or flat surface within a transport vehicle, may be discussed. In the prior art, the gun lockbox itself could be stolen if attached to a stationary object such that the attaching hardware was accessible. In the present invention, clip members 30 preferably include a wall bracket 32 having two to four counterbored holes sized to receive conventional fasteners 34 such as screws or bolts. A corresponding housing bracket 36 is attached to the inside surface of the upper housing 12 with two to four conventional fasteners 38, having protruding and rounded heads 39 on the outside of the housing 12. A pair of mounting pins or bolts 40, having knurled or plastic knobs for easy grasping, secure the housing bracket 36 and wall bracket 32 together. In this way, the mounting bolts 40 are only accessible from inside the gun lockbox 10, which may be securely locked to prevent access to such attaching hardware. The brackets 32 and 36 are preferably fabricated of corrosion-resistant steel, other suitable metal, or composite. Alternatively, as shown in FIG. 7, the housing bracket 36 may be attached to the exterior, rather than interior, of the upper housing 12. Still, the mounting bolts 40 are installed from inside the gun lockbox 10.

Referring back to FIGS. 5 and 6, alignment means for positioning the gun lockbox 10 to the stationary object or wall may be discussed. Recall that in the prior art it was difficult to position an elongate gun case to a wall, the attaching hardware being inaccessible after completing the installation. In the present invention, the gun lockbox 10 of the preferred embodiment includes a pair of parallel, raised ribs 42, spaced apart the approximate width of each wall bracket 32. Additionally, the protruding, rounded heads 39 of the fasteners 38 used to install each housing bracket 36 are separated a distance approximately equal to the length of the wall bracket 32. In this way, it is possible upon first installing each wall bracket 32 to place the gun lockbox 10 against the wall bracket 32, such that the ribs 42 are on either side and the protruding heads 39 of the fasteners 38 are on either end.

Having described the structure of the gun lockbox 10 of the preferred embodiment, it is now possible to describe the operation, function, and use in accordance with the present invention. The rifle, shotgun, or other large weapon is placed inside the gun lockbox 10, and the housing halves 12 and 14 are brought together such that the latch means 22 may be fastened. The lockbox 10 may then be secured by turning each of the locks 20, such that the twist arm 28 engages the guard member 18. The lockbox 10 is now securely locked, and importantly is resistant to forced entry by inserting a crowbar or other prying tool between the housing halves 12 and 14. The strong yet lightweight lockbox 10 may be hand carried through use of the convenient handle 15.

Additionally, the lockbox 10 may be mounted to a transport vehicle in the rear portion of the passenger compartment or in the trunk, or mounted to some other stationary object such as a wall. One or more housing brackets 36 are first attached to the upper housing 12 of the lockbox 10. Then the upper housing or the housing bracket is preliminarily positioned to the wall, for marking through the apertures for installation to the wall brackets 32. Next, the upper housing 12 of the lockbox 10 is finally located to the wall, by positioning the protruding ribs 42 to the respective sides of the wall brackets 32, and by positioning the protruding heads 39 of fasteners 38 to the top and bottom edges of the wall brackets 32. Finally, mounting pins 40 are installed from inside the lockbox 10, and the lockbox may be closed and locked which makes the attaching hardware inaccessible.

It is also possible to practice the present invention by retrofitting a conventional gun case, i.e., making certain modifications to provide a secure lockbox and carrying case not subject to being tampered with or stolen. This would involve installation of a guard member 18 and one or more locks 20 to adjacent edges of the housing halves 12 and 14. Additionally, this may involve installation of housing brackets 36 to the upper housing 12 for use as clip 30 to mount the lockbox 10 to a stationary object.

It is understood that the exemplary secure lockbox and carrying case for guns described herein and shown in the drawings represents only a presently preferred embodiment of the invention. Indeed, various modifications and additions may be made to this embodiment without departing from the spirit and scope of the invention. These and other modifications and additions may be obvious to those skilled in the art and may be implemented to adapt the present invention for use in a variety of different applications.

What I claim is:

1. A securable case resistant to forced entry comprising:

first and second housings coupled together, each having generally flat adjacent sides which may be brought together and come in contact to close the securable case, and said flat sides thereby defining a front plane when said housings are in a closed condition;

a guard member having a securing portion and a generally flat upstanding portion, said upstanding portion attachable along a substantial length of an inside edge of said first of the housings, said upstanding portion extending past the adjacent side of said second housing when the securable case is in said closed condition, said securing portion of said guard member adapted to be engaged for securing said housings together in said closed condition;

a lock mounted through said adjacent side of said second housing, and generally perpendicular through said front plane, said lock being movable to a locked position in close proximity to and overlying said securing portion of said guard member without extending through said guard member, such that said adjacent sides of the housings being secured together when the case is in said closed condition and said lock is in said locked position without extending through said guard member; further comprising a second lock mounted through said adjacent side of said second housing, and generally perpendicular through said front plane, opposite the first lock, such that said guard member lying between said locks when the case being in said closed and a locked condition, thereby reducing any forced movement of said guard member and said first housing and second housing;

whereby said guard member resists insertion of a prying tool along said substantial length of said adjacent sides between said housings in said front plane while providing a locking surface to engage said locks.

2. The securable case of claim 1 wherein said guard member having a generally L-shaped cross section with said securing portion being generally perpendicular to said upstanding portion, and wherein said securing portion extends outside said front plane defined by said adjacent sides of said housings in said closed condition.

3. The securable case of claim 1 wherein the locks are twist locks, having a stem portion perpendicular to said front plane, and an arm portion movably attached to said stem portion, and rotatable to overlie said securing portion of said guard member and provide locking engagement.

* * * * *